US006439572B1

(12) United States Patent
Bowen

(10) Patent No.: US 6,439,572 B1
(45) Date of Patent: Aug. 27, 2002

(54) BASEBALL AND SOCCER TRAINING SYSTEM FOR CHILDREN

(76) Inventor: Teresa H. Bowen, 2613 Regatta Ln., Davis, CA (US) 95616

( * ) Notice: Subject to any disclaimer, the term of this patent is extended or adjusted under 35 U.S.C. 154(b) by 0 days.

(21) Appl. No.: 09/629,545

(22) Filed: Jul. 31, 2000

(51) Int. Cl.[7] ..... A63F 3/00
(52) U.S. Cl. ..... 273/239; 273/244.2
(58) Field of Search ..... 273/244.1, 244.2, 273/239, 429, 430, 431, 432, 236

(56) References Cited

U.S. PATENT DOCUMENTS 1,581,189 A * 4/1926 Fuchs
2,812,181 A * 11/1957 Richman
2,946,134 A * 7/1960 Neilson
3,124,356 A * 3/1964 Chordas
4,000,897 A * 1/1977 York
4,634,125 A * 1/1987 Seklecki
4,653,755 A * 3/1987 Panella et al.
5,664,780 A * 9/1997 Bricker
5,762,337 A * 6/1998 Poisson
5,820,127 A * 10/1998 Rodriguez
5,827,072 A * 10/1998 Neufer et al.

* cited by examiner

*Primary Examiner*—Paul T. Sewell
*Assistant Examiner*—Nini Legesse
(74) *Attorney, Agent, or Firm*—Richard T. Holzmann

(57) ABSTRACT

A system for training and coaching field and court sports, and more particularly, for baseball and soccer for children. Included as elements are a magnetic game board, a multiplicity of miniature figurines, as well as nameholders for each player. Flash cards and answer key elements are used to challenge the young player's growing knowledge of the sport. A beginning child must identify the various parts of the field and place the figurines in the proper playing positions. He or she when shown a flash card having few words thereon, must explain the meaning of the card. A coach or parent with little experience can read an answer key to determine correctness of a response. The principle of the system, essentially no different for baseball or soccer, may be readily structured for other field and court sports. A method of playing a tabletop baseball board game based on this system of training/coaching is also disclosed.

17 Claims, 5 Drawing Sheets

BASEBALL AND SOCCER TRAINING SYSTEM FOR CHILDREN

FIELD OF THE INVENTION

A system for training and coaching field and court sports, and more particularly, for baseball and soccer for children.

BACKGROUND

Organized youth sport's teams have almost doubled in the last seven years and have created a steep demand for new coaches. Reliable estimates place the total number of volunteer coaches this year in the U.S. in excess of three million. A large percentage of these people are completely unqualified. Many have not engaged in the sport for 20 years and have zero experience teaching children. In sports like soccer, some have never even seen a game on television let alone kicked a ball around. Many leagues are now starting to require coaches to attend training clinics.

Indeed, a whole industry has sprung up to teach fledgling coaches, and about 200,000 new coaches are trained every year. In some Little Leagues, coaches have to attend five meetings and classes during the year, umpire at least two games . . . and soon may have to pass a comprehensive test. New instructional books are coming out every year. Internet coaching sites are appearing with tips on everything from badminton to lacrosse. Nevertheless, not surprisingly, the average coach's career is short-lived, usually about two to three years, that is, while the coach's child is engaged in the sport.

There is prior art for use by coaches of various kinds of boards that simulate baseball or soccer or other types of sport fields and courts. However, these are designed for the use of a coach and do not directly involve the beginning and intermediate 6–12 year-old child who is learning the sport. For example, in U.S. Pat. No. 2,946,134 Neilson discloses a rigid transparent sheet representing the playing area overlaying a player assignment sheet upon which player simulated figurines fashioned to represent football players in different stances are placed indicating the different playing positions. The movement of the ball carrier and other players can be indicated by drawing lines on the transparent surface.

Baldine in U.S. Pat. No. 2,579,105 discloses another game teaching apparatus comprising a foldable gameboard having magnetic sheeting covering the board whereby magnetic playing elements can be disposed on the board. Furthermore, these magnetic playing elements have a chalk-holding ability for indicating the direction of their movement.

Neufer et al in U.S. Pat. No. 5,827,072 disclose sports-related instruction boards having transparent surfaces on both sides between which first and second graphic display panel surfaces can be permanently sealed inside the board structure. Various boards are used for soccer, basketball, football, and baseball. A writing instrument containing dry-erasable ink is removably attached to the board surface.

Each of the above, as well as others which could have been cited, have a gameboard upon which player figurines, magnetic or not, can be placed and which can be written on to illustrate movement of the players. These boards are primarily used by coaches but are inadequate by themselves to teach the younger and intermediate player. To teach the various levels of beginning field sports, there must be interaction between the coach and the players. Furthermore, especially for the very young players of T-ball, for example, who can not yet read, black and white drawings do not work well. The young child needs a visually realistic image in order to fully comprehend the subject matter. Consequently, this must be reflected in the elements used if the learning experience is to be maximized.

It is therefore an object of the instant invention to provide a system which can capture and hold the attention of beginning and intermediate players while teaching the fundamentals of the sport.

It is another object to provide a simulated magnetic-reactive and write-on surface for diagramming tactics or "chalk talk."

It is a further object to provide magnetic figurines that can be moved to teach positions and defensive strategies.

It is yet another object to provide magnetic name holders for containing cardboard inserts for identifying players on the team for use on the magnetic surface.

It is also an object to provide color-coded flash cards for grouping into categories to teach children basic concepts of the game: such as the field, the players, offensive skills and techniques, defensive rules and techniques, and advanced strategies. Blank cards are needed for coach customization.

It is an object to provide an answer key explaining all the concepts on the flash cards. No previous experience is therefore necessary to teach the basics of the game.

It is a further object to provide materials which are photo-realistic for better visualization for the very young player.

An object is to provide a method of playing a tabletop baseball board game.

SUMMARY OF THE INVENTION

This system for training beginning and imtermediate players in baseball basics comprises the following elements: a game board means having a simulated, realistically colored baseball field illustrated thereon; a multiplicity of miniature magnetic figurines; a multiplicity of magnetic name holders having therein spaces for the insertion of player name cards; a multiplicity of flash cards; and an answer key including a plurality of images of a baseball field.

The method steps of said system comprising: identifying the parts of said baseball field on the game board means by each player; placing said minature magnetic figurines in the correct position on the game board; placing said magnetic name holders having name cards of said players inserted therein in correct position on the board; displaying said flash cards having questions in the form of concise terms thereon by the coach; soliciting responses to said questions from each player; and reading said answer key to determine correctness of the response from said player.

In this instant system the game board means further includes a magnetic-reactive, write-on surface, having scoreboard and at bat lineup portions thereon for teaching parts of a field, positions of players and diagramming strategies. Said miniature magnetic figurines include sufficient representations of each player type; and said multiplicity of magnetic name holders further comprises player name cards for insertion into the slots therein. Said multiplicity of flash cards include concise terms thereon grouped into categories to teach children basic baseball concepts. Said answer key includes a plurality of images of baseball fields and the definitions of those terms posed on the flash cards. Said plurality of images of a baseball field comprises a first image including numbers only for player positions thereon and a second image having written descriptions of the parts of said field thereon.

The instant invention also embodies a system for training beginning and intermediate players in soccer basics wherein the parts of said system comprise not only the same kinds of elements cited above for baseball, but also the same kinds of method steps. Rearrangement of the elements and method steps of the instant invention results in the invention of a method of playing a tabletop baseball board game which is also disclosed.

BRIEF DESCRIPTION OF THE DRAWINGS

The above and other objects, features and advantages of the present invention will be more clearly understood from the following detailed description taken in conjunction with the accompanying drawings which disclose one embodiment of the present invention. It should be understood, however, that the drawings are designed for the purpose of illustration only and not as a definition of the limits of the invention.

DESCRIPTION OF THE PREFERRED EMBODIMENT

In accordance with the preferred embodiment of the present invention there is provided a new and improved system for teaching and coaching beginning and intermediate children who are relatively unfamiliar with the sport of baseball.

Figure 1:
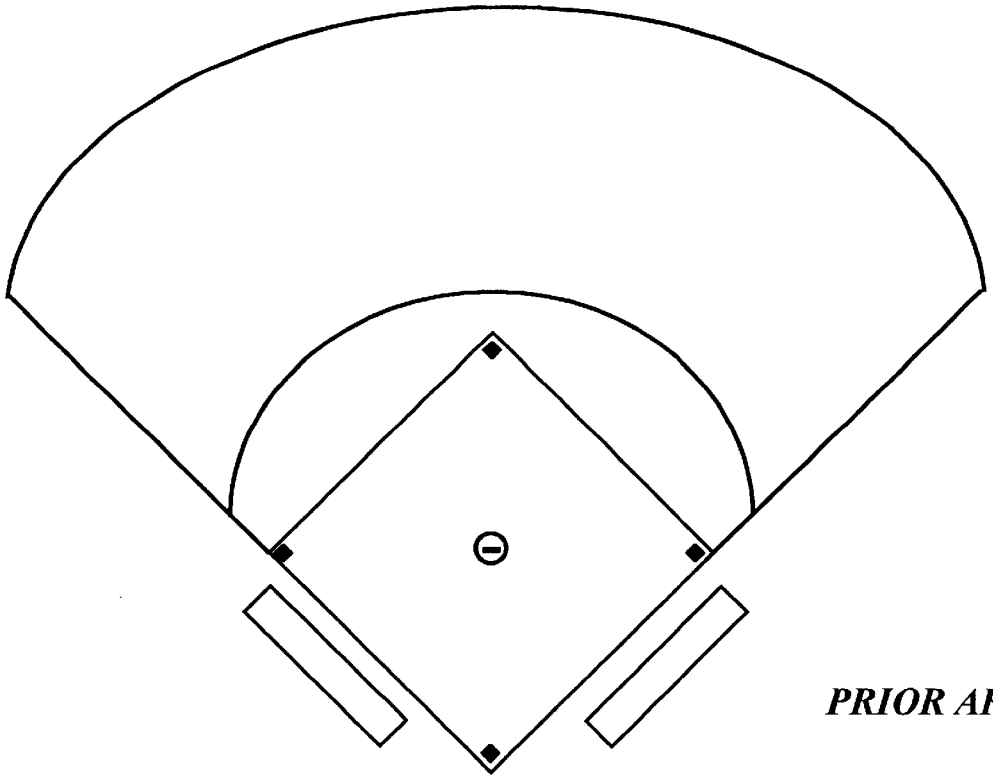
PRIOR ART Figure 1
FIG. 1 is a plan view of a Prior Art baseball playing field.

Referring now in detail to the drawings and in particular FIG. 1 thereof, is a plan view of a prior art baseball playing field of the present invention which includes a generally pie-slice shaped field. This illustration encompasses the diamond, i.e., the space enclosed by home plate and the three bases, the infield. Of course, the term diamond, in a general way, also refers to the entire playing field, i.e., the infield and the outfield combined.

Figure 2:
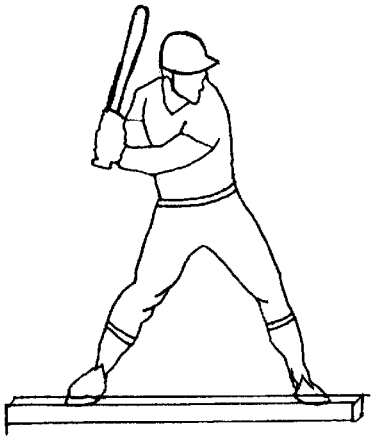
PRIOR ART Figure 2
FIG. 2 is a front view of a Prior Art miniature baseball player.

Prior art Figurines, such as the batter shown in FIG. 2, represent players on the two teams which can be manually moved around the field to represent fielding positions. They need not be magnetic since they will usually be used with the board placed in a flat position on a stable surface such as a bench, table or on the ground. On the other hand, magnetic figurines are more useful in a rougher outdoor environment in order to keep them in place. For more advanced players, the figurines can be moved to simulate various plays.

Figure 3:
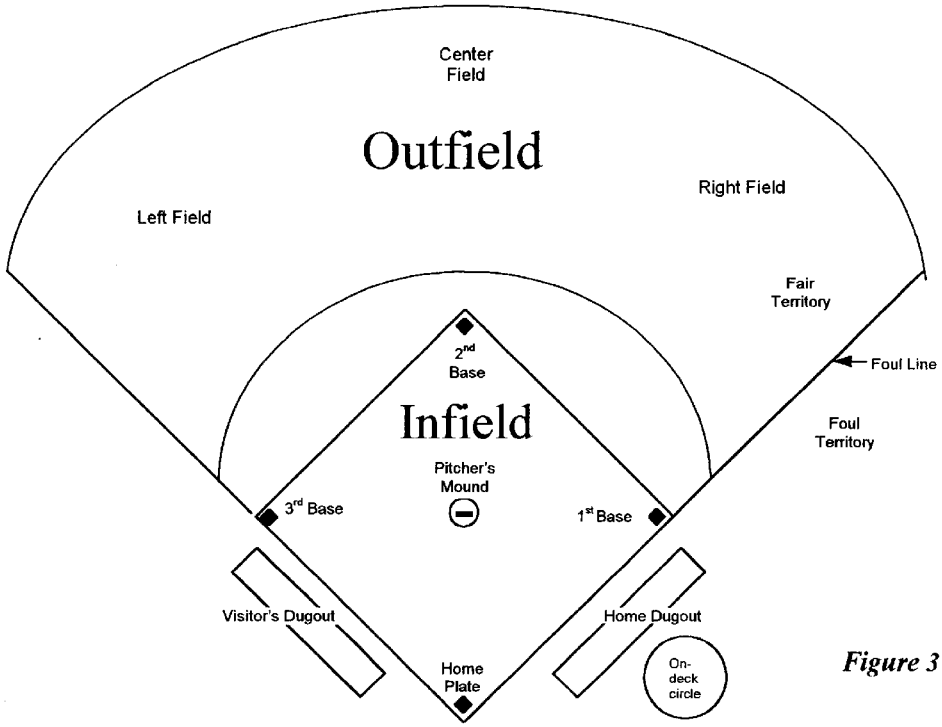
FIG. 3 is a plan view of the playing field of FIG. 1 with the various parts of the field identified.
Figure 4:
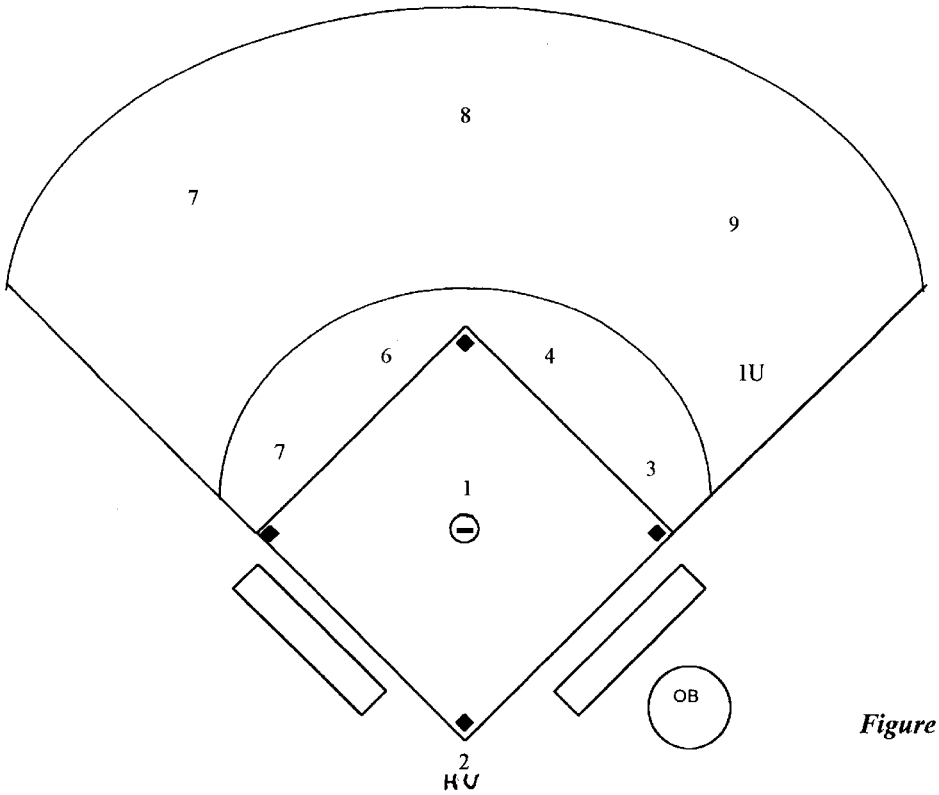
FIG. 4 is an additional plan view of the playing field of FIG. 1 with the positions of the players and umpires identified.

FIG. 3 and FIG. 4 are additional plan views of the playing field of FIG. 1 with the parts of the field (FIG. 3/Table 1) specifically identified thereon; and positions of players and umpires (FIG. 4/Table 2) identified, only by numbers, for instructional purposes. These figures are not shown to the very young players since many cannot yet read or count. They are provided only on an Answer Key discussed below.

TABLE 1

| THE FIELD (green cards)- See FIG. 3 | | | |
|---|---|---|---|
| 1 | Home Plate | 9 | Right Field |
| 2 | First Base | 10 | Center Field |
| 3 | Second Base | 11 | Foul Line |
| 4 | Third Base | 12 | Foul Territory |
| 5 | Pitcher's Mound | 13 | Fair Territory |
| 6 | Infield | 14 | Home Dugout |
| 7 | Outfield | 15 | Visitor's Dugout |
| 8 | Leftfield | 16 | Ondeck Circle |

TABLE 2

| THE PLAYERS (white Cards)- See FIG. 4 | | | |
|---|---|---|---|
| 1 | Pitcher | 8 | Center Fielder |
| 2 | Catcher | 9 | Right Fielder |
| 3 | First Baseman | | and |
| 4 | Second Baseman | B | Batter |
| 5 | Third Baseman | OB | On-deck Batter |
| 6 | Shortstop | HU | Home Plate Umpire |
| 7 | Left Fielder | 1U | First Base Umpire |

Figure 5:
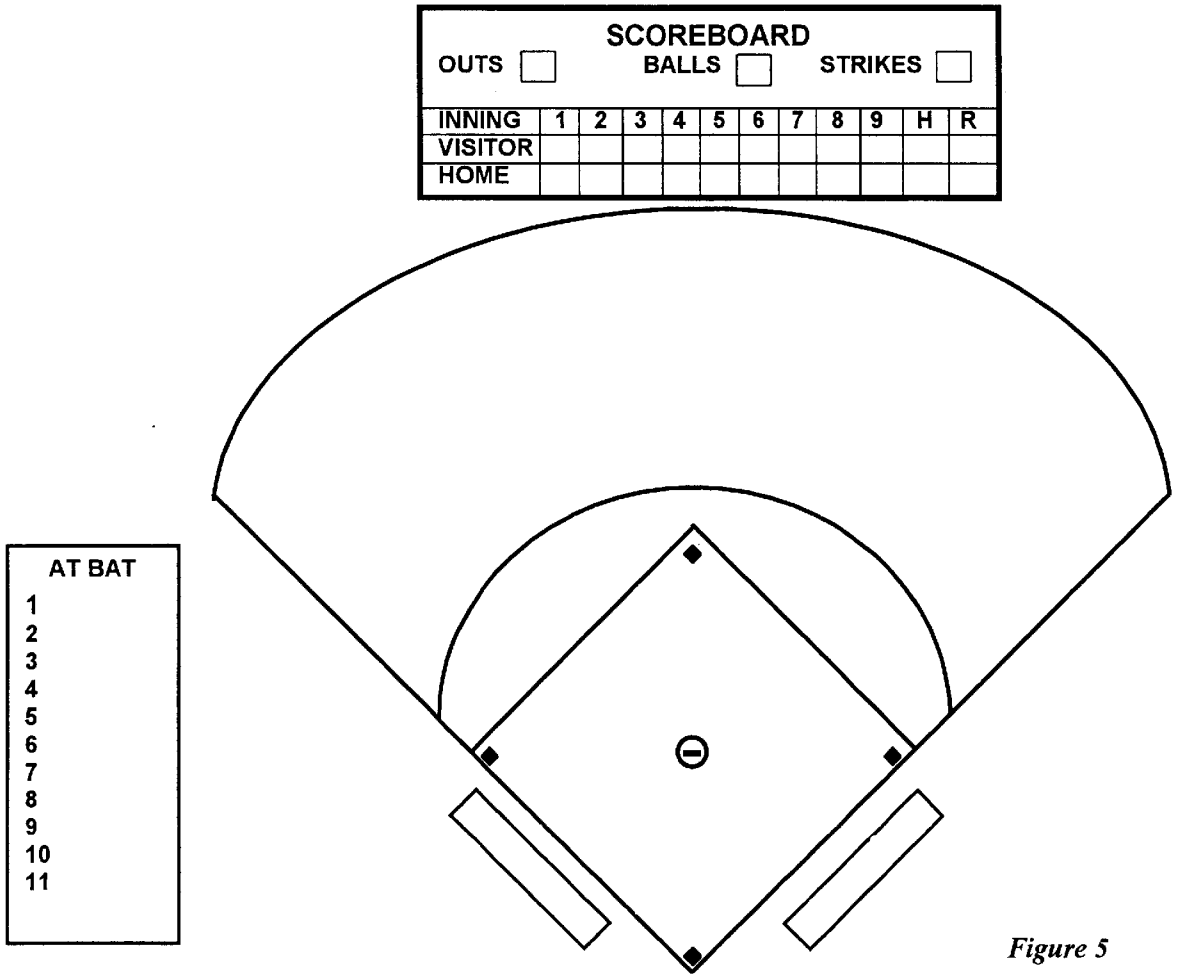
FIG. 5 is another plan view of the playing field of FIG. 1 having a scoreboard and a batting lineup thereon.

Illustrated in FIG. 5 is a drawing of FIG. 1 having a scoreboard associated therewith as well as an at bat lineup portion. Embodied in this invention is a physical model (FIG. 5*a*) of the baseball image of FIG. 5 in its simplest form, mounted on a flat board which can be folded for easier transport to the practice field. This board means has a simulated, realistically colored baseball field illustrated thereon. Colors of choice may be green for the grass; brown or some similarly good contrasting color for the base-running area; and other contrasting colors for the dugout locations and the backup fence behind the catcher. This can be used by coaches and parents as a visual, physical aid to teach young baseball players (ages 5–9) baseball basics such as the names of the different parts of the field as shown in FIG. 3, and the positions of players as numbered in FIG. 4. The board has a magnetic reactive and write-on, wipe-off surface for diagramming strategies or "chalk talk." It allows for tilting for improved visualization. The size of the board found to be most useful is about 18"×24". The figurines can be packed with the folded board for easy carrying.

Figure 5A:
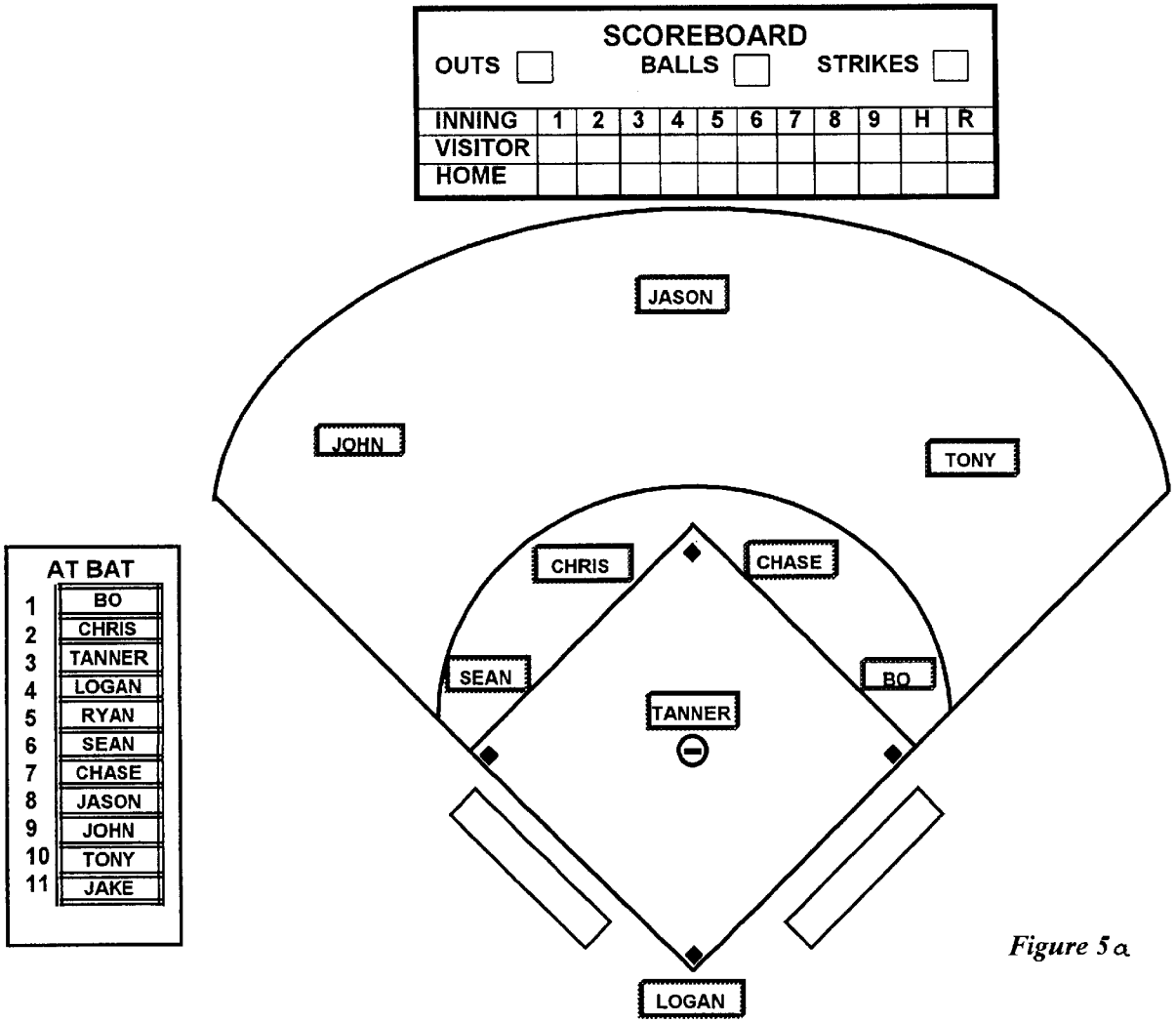
FIG. 5*a* is a further plan view of FIG. 5 with magnetic name holders having the name cards of active players in place.

The FIG. 5*a* plan view of the playing field of FIG. 5 has the magnetic name holders of the active players in place. This board can be hung on a chain-link fence in the dugout during games using these name holders to insure that the players know the position they have been assigned. It should be observed that many coaches move the position of a younger player around to give him broad experience as well as to identify the best position in accordance with his talent. Two magnetic nametags for each player identify the offensive (batting order) and defensive (fielding positions) lineup.

The nametags are moved each inning for the players and coaches to view the current positions. These name holders are magnetic and contain cardboard inserts for identifying players on the team. Runs per inning can be written on the scoreboard; while name holders can be placed in the batting order section.

Figure 6:
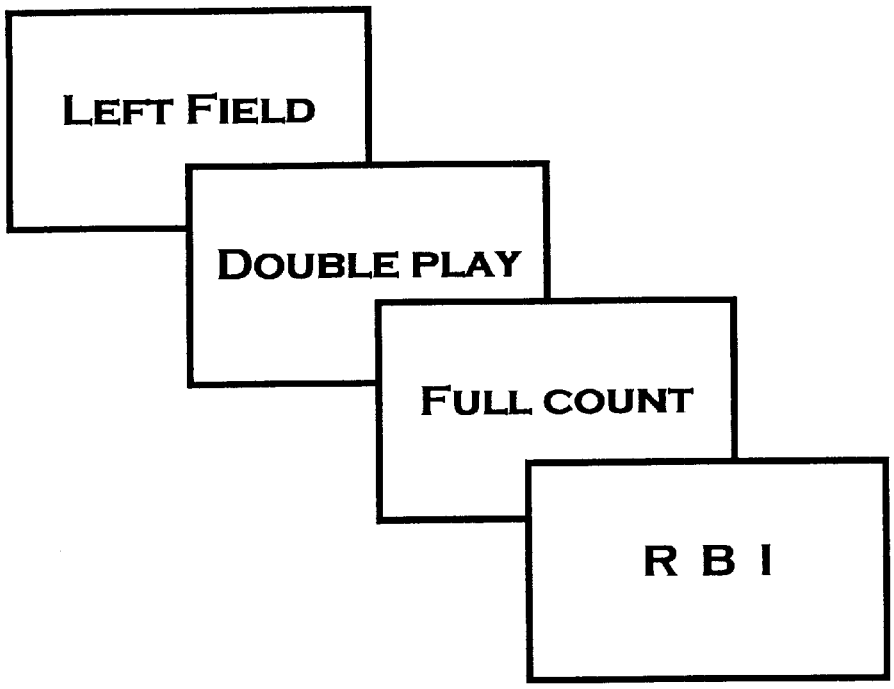
FIG. 6 is an example of the types of flash cards used in the training/coaching system of the invention.

FIG. 6 is an example of the types of Flash Cards used in the training/coaching system of the invention. One way of practicing the invention is to color code the cards and group them into categories of increasing difficulty to teach children basic concepts of the sport. The following five categories have been found to work well; the field (Table 1), the players (Table 2), offensive skills and techniques, (Table 3) defensive skills and techniques (Table 4), and advanced strategies (Table 5). Other categories may be used and thus blank cards should be made available for customization by coaches. An Answer Key defines the main concepts of the sport on the Flash Cards and can lead to useful discussion among the players. No previous baseball experience is necessary to teach the basics of the game.

Thus, the instant invention consists of the five following elements:

1. A game board means having a simulated, realistically colored baseball playing field thereon;
2. miniature magnetic figurines;
3. a multiplicity of magnetic name holders for player name card inserts;
4. a multiplicity of flash cards having concise terms thereon; and
5. an answer key including a plurality of images of a baseball field.

As for the method of teaching/coaching the sport, it should be appreciated that today many children at a very young age, even before they can read, are learning to play baseball and other sports. Therefore, the level of skill and understanding is commonly divided into several levels of play as has been done for many leagues: T-ball (ages 5 and 6), Farm League (ages 7 and 8), AA Division (ages 8 and 9), and AAA (ages 10 and 11). These levels vary among leagues and, of course, the age limits are a general guide; children with superior skill can move up quickly regardless of age. The flash cards are therefore grouped by color into categories of increasing difficulty. As the children advance in their level of comprehension, the next level of flash cards are used. Consequently, any listing of sample concise terms, questions and points of discussion must be suited to the different levels of comprehension and skill.

The following ANSWER KEY to the terms identified and questions raised on the flash cards, in one version, may be printed on both sides of a sheet of paper which when laminated provides a durable training guide.

It is emphasized that these color coded cards and the answer key hardly exhaust the number of terms and situations that occur in a baseball game, and they ought to be considered as illustrative only. Many more could be added, for example: terms such as ERA, Texas Leaguer, designated hitter, southpaw, and the like.

Although the instant invention is designed for beginning players, more experienced players are challenged by the red flash cards which describe advanced play and terms. The invention should be used during regular practice in a number of situations, e. g., "as a station during rotations." In Little League, team members are divided into several groups, each group constructed by a different coach in a different skill such as fielding, throwing and batting for rainy day practice and when players are tired or injured to keep them involved in the practice or for a fun end to a physically demanding practice, a cool down. It should be used right on the field during practice.

There are many ways to play but what follows are a few recommendations. For the very beginning T-ball players, 4–6 year olds, many will not yet be reading, so one might start with just the baseball playing field image as shown in FIG. 1. Questions may be asked about this field such as: Where is first base? Where is right field?, etc. After the parts of the field have been covered, one may wish to show the plan view of the playing field of FIG. 3 on the answer key with the various parts of the field identified and then the players can be questioned on these parts to reinforce their memories. After the parts of the field have been covered, the coach may wish to introduce the figurines of FIG. 2 and can have the children place them in their proper positions. If you were the catcher, where would you stand? Where should the shortstop play?

The inexperienced coach can refer to the Answer Key for basic descriptions. The players can then be shown a base hit by adding a marble (ball) to the system rolling the ball from home plate to the outfield. Explain to them the infield positioning and why basemen should not stand directly on the base. Have the children try to get a base hit by rolling the marble. Move the fielders around and have them try again. They will quickly see that it is harder to get the ball past the infield if there are no "holes" between players.

Older players between the ages of 6 and 11 years old, are usually ready for playing the game with the flash cards (examples are illustrated in FIG. 6). The cards are grouped by color and level of difficulty. For example, the green cards may describe parts of the field and are the easiest, followed by white (players), blue (offense), yellow (defense) and red (advanced play). While it should be emphasized that there are a number of ways to structure the method of teaching the game, the coach can develop his or her own techniques as experience is gained. On the other hand, more experienced children may be given the answer key as a handout to refresh their memory.

One recommended approach is as follows:

1. Sit the team in a circle around the board of FIG. 5*a*. Starting with the green (field) flash cards (Table 1), have a player draw a card and point to that part of the field described on the card. If he answers correctly, he keeps the card. If he does not answer correctly, he passes the card to his right and the next player tries to answer. This continues until either the correct answer is given or each child has had a turn to answer. If no one answers correctly, the coach tells them the answer and puts the card back on the bottom of the deck.

2. The next child draws a new card and continues as above.

3. Once all the green cards are drawn, the children begin drawing the white cards (Table 2).

4. For white (player) cards, the child should place the magnetic figurines on the board in the correct fielding position.

For blue (offense: hitting and scoring) cards (Table 3), yellow (defense: outs) cards (Table 4), and red (advanced play and terms) cards (Table 5), the child should explain the skill or demonstrate using the magnetic players and the board.

TABLE 3

OFFENSE: HITTING and SCORING (Blue Cards)

base hit—A ball hit and the batter reaching a base safely.

base-on-balls (walk)—Advancing to first base after 4 balls have been pitched.

base runner—An offensive player or is either on base or attempting to reach a base.

base stealing—Advancing to the next base without a ball being hit.

bases loaded—The condition when runners are on all 3 bases.

bunt—A method of hitting by holding the bat so that a pitch is hit softly.

double—A hit that allows the batter to reach second base safely.

foul ball—A batted ball that lands in or rolls into foul territory before passing first or third base.

fly ball—A hit that sails high into the air.

ground ball—A hit that bounces or rolls along the ground, also known as a grounder.

inning—A division of a game that consists of each team having a turn at bat.

home run—A hit that allows the batter to reach home safely.

run—The basic unit of scoring that is credited each time a base runner advances safely to home plate.

single—A hit that allows the batter to reach first base safely.

sliding—A way of reaching a base by hitting the ground in front of the base and sliding feet first into the bag.

triple—A hit that allows the batter to reach third base safely.

TABLE 4

DEFENSE: OUTS (Yellow Cards)

double play—A defensive play that results in putting two players out.

error—A defensive mistake that allows a runner to advance or reach a base safely whereas that player otherwise would have been unable to advance or be put out.

fly out—A fly ball that is caught, resulting in the batter being put out.

forced-out—An out resulting from the ball reaching a base before the runner, who had no choice but to advance.

groundout—A ground ball that is fielded by an infielder, resulting in the batter being put out.

strikeout—A batter being put out as the result of having a third strike.

tag out—A defensive play resulting in an out where a fielder in possession of the ball touches a runner in the base path.

triple play—A defensive play that results in putting three players out.

TABLE 5

ADVANCED PLAY and TERMS (Red Cards)

ball—A pitch that is thrown outside the strike zone.

balk—An illegal motion by the pitcher resulting in a ball being credited to the batter and runners advancing one base.

change-up—A slow pitch thrown to deceive the batter by using the same motion as a fastball.

curveball—A slow or moderate speed pitch thrown with spin to veer away from its expected course.

cut-off player—An infielder who receives a ball thrown from deep in the outfield to relay the ball to home plate.

fastball—A pitch thrown at high speed, which typically rises slightly as it nears home plate.

fielder's choice—A situation that allows a batter to reach base safely because a fielder decides to put out a different base runner.

full count—The situation when the batter has three balls and two strikes.

grand slam home run—A home run that occurs when the bases are loaded. Four runs are scored.

lead—A position taken by a base runner off the base and towards the next base.

leadoff—The first batter in an inning.

passed ball—A pitch not hit by the batter that passes the catcher and should have been caught.

RBI (run batted in)—A run that is driven in by a batter.

retired batter—A batter who has been put out.

sacrifice fly—A fly ball that results in the batter being put out, though the base runner(s) advances.

scoring position—Second or third base, from which a batter could score on a base hit.

seventh inning stretch—The period in the middle of the 7th inning when fans traditionally stand up to stretch.

strike zone—The area over the home plate through which a pitch must pass to be called a strike.

tag-up—The action of a base runner remaining in contact with a base during a fly ball, with the intention of advancing to the next base after the ball is caught.

wild pitch—A pitch not hit by the batter that passes the catcher and could not have been caught.

At the end of the session baseball trading cards can be awarded to each child holding a flash card to further the love of baseball.

During actual games Little League coaches often change players fielding positions, sometimes every inning. Therefore, the board should be taken to the dugout. The magnetic name tags as shown in FIG. 5*a* (which also includes the scoreboard and the batting order) can be quickly moved to new fielding positions and the batting order updated every inning. The board can be hung in the dugout where players can see it, thus player rotations and batting will go much more smoothly.

Figure 7:
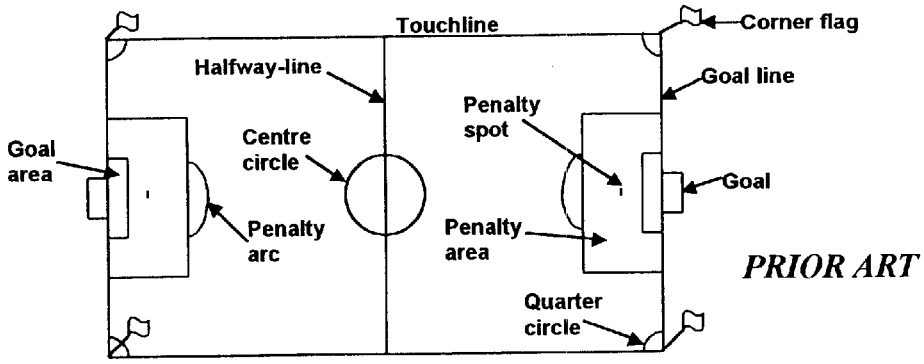
FIG. 7 is a plan view of a representative Prior Art soccer playing field.

FIG. 7 is a plan view of a representative Prior Art soccer playing field. Unlike baseball, soccer readily lends itself to the type of diagramming of plays by coaches and players common to football and some other field sports. Nevertheless, the elements and method for training/coaching a system for soccer are no different from those disclosed above for baseball. (See Tables 6–10) And, incidentally, this system may be used for football, field hockey, basketball, ice hockey and the like without departing from the generalized baseball system.

TABLE 6

THE FIELD (green cards) - See FIG. 7

| | | | |
|---|---|---|---|
| 1 | Goal Area | 6 | Penalty Area |
| 2 | Penalty Arc | 7 | Goal |
| 3 | Centre Circle | 8 | Quarter Circle |
| 4 | Touchline | 9 | Penalty Spot |
| 5 | Halfway Line | 10 | Goal Line |

TABLE 7

THE PLAYERS (White Cards)

Defender—plays near her own team's goal and tries to prevent the other team from shooting the ball Goalkeeper—plays in front of the goal and is responsible for keeping the ball out of your team's goal Linesmen—assists the referee Midfield player—an all-purpose player who shoots and also tries to steal the ball from the other team Referee—sole responsibility for officiating the game Striker—attacker whose main job is to score goals Sweeper—a defender who plays behind other defenders in case any balls get through Wing—an attacker who plays nearest the touchlines

TABLE 8

TECHNIQUES/SKILLS (Blue Cards)

Dribbling—running with the ball, controlling it closely

Heading—using your head to change direction or to control the ball

Marking—guarding an opposing player

Passing—kicking a ball under control to a teammate

Shooting—a ball kicked to score a goal

Tackling—taking the ball away from an offensive player

Trapping—receiving and controlling passes

TABLE 9

THE RULES (Yellow Cards)

Coin toss—a coin is tossed and the team which wins the toss decides which goal it will attack in the first half of the match, the other team takes the kickoff to start the match Corner kick—a kick taken from one of the quarter circles awarded after a defender kicks the ball over the goal line Drop ball—a way of restarting the game by dropping the ball between two opposing players Free kick—a kick awarded to the other side after a foul has been committed Goal kick—a kick awarded to the defending team when the attacking team kicks the ball over the goal line but not into the goal Hand ball—deliberating handling the ball with your hands Kickoff—a kickoff is taken from the centre circle at the beginning of the game, beginning of the second half and after each goal Off-side—a player is in an off-side position if she is in the opponent's half of the field and nearer to the opponent's goal than the ball, unless there are at least 2 defending players (counting the goal keeper) even with or between the player and the goal line Penalty kick—a free kick at goal awarded to the attacking side when one of them is fouled in their opponent's penalty area Throw-in—a method of restarting the game when the ball has gone out of play over the touch-line

TABLE 10

ADVANCED PLAY (Red Cards)

Block tackle—a way of tackling your opponent head-on and gaining possession of the ball while still on your feet Chip pass—a pass used to kick the ball over a defender by kicking it into the air at a sharp angle using a stabbing action Half volley—kicking the ball just as it bounces and starts to rise Jockeying—slowing an opponent who is in possession of the ball by blocking off any intended runs and being ready to tackle Overhead—a shot used when you have your back to the goal; done with both legs in the air by flipping ball back over your head Screening—a way of retaining possession of the ball by keeping your body between an opponent and the ball Sliding tackle—clearing the ball from an opponent Volley pass—a pass made by kicking the ball while it is still in the air A method of playing a tabletop baseball board game for a plurality of game players each of said game players competing against each other to collect the most baseball trading cards is disclosed. As with the training/coaching system for baseball above, the parts of said game comprise a multiplicity of flash cards, each of which represents one aspect of baseball expressed in a concise term thereon; a substantially planar game board means having indications thereon describing a baseball diamond having a home plate, a first base, a second base, a third base, an at bat portion listing the names of each player in the order of play, and a scoreboard for listing the number of trading cards won by each of said game players; a multiplicity of name holders for holding the individual names of each game player; and an answer key. The method steps of the baseball game comprising each game player: throwing dice to determine a coach for a session; defining a concise term by one of said game players on a first of said flash cards displayed by the coach; failing to properly define said term resulting in said flash card being displayed to a second game player; properly defining said term resulting in retention of said flash card by said second game player; continuing to display cards by the coach to additional players in this manner until all said flash cards of a session have been retained by said game players; and replacing said flash cards with baseball trading cards in numbers equivalent thereto to each player possessing any of said flash cards. The tabletop baseball board game means can be approximately the saim size of the training/coaching board or somewhat smaller.

Since the present invention is constituted as explained above, the meritorious effects of the preferred embodiment of this invention as enumerated in its purpose as disclosed above, are readily achieved by use of the elements and method of the instant invention. It has been found that this training and coaching system not only works well with the ages for which it was designed but it does so with a level of unusual enthusiasm and fun. The new vocabulary and many new concepts introduced to the children are remembered effortlessly because they are conveyed in the atmosphere of an entertaining game. Furthermore, the coaches get to know the individual player's strengths and weaknesses more quickly than by using other current methodology.

This system captures and holds the attention of younger players while teaching the fundamentals of the sport. It provides a simulated magnetic-reactive and write-on surface for diagramming tactics or "chalk talk." It also provides magnetic figurines that can be moved to teach positions and defensive strategies; and magnetic name holders for containing cardboard inserts for identifying players on the team for use on the magnetic surface. Finally, the color-coded flash cards and answer key teach children basic concepts of the game: these include the field, the players, offensive skills and techniques, defensive rules and techniques, and advanced strategies. Blank cards are included for customization. No previous experience is therefore necessary to teach the basics of the sport.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A system for training beginning and intermediate players in baseball basics comprises the following elements:

a game board means having a simulated, realistically colored baseball field illustrated thereon;

a multiplicity of miniature magnetic figurines;

a multiplicity of magnetic name holders;

a multiplicity of flash cards; and an answer key including a plurality of images of a baseball field; the method steps of said system comprising each player:

identifying the parts of said baseball field on the game board means;

placing said miniature magnetic figurines in the correct position on the game board means;

placing said magnetic name holders having name cards of said players inserted therein in correct position on the game board means; and further comprising each coach:

displaying said flash cards having questions in the form of concise terms thereon;

soliciting a response to said questions from each player; and reading said answer key to determine correctness of the response from each player.

2. The system of claim 1 wherein the game board means further includes a magnetic-reactive, write-on surface, having scoreboard and at bat lineup portions thereon for teaching parts of a field, positions of players and diagramming strategies.

3. The system of claim 1 wherein said miniature magnetic figurines include sufficient representations of each player type.

4. The system of claim 1 wherein said multiplicity of magnetic name holders further comprises player name cards for insertion into the slots therein.

5. The system of claim 1 wherein said questions on said multiplicity of flash cards are expressed as concise terms thereon grouped into categories to teach children basic baseball concepts.

6. The system of claim 1 wherein said answer key includes a plurality of images of baseball fields and the definitions of those terms posed on the flash cards.

7. The system of claim 6 wherein said plurality of images of a baseball field comprises a first image including numbers only for player positions thereon.

8. The system of claim 6 wherein said plurality of images of a baseball field comprises a second image having written descriptions of the parts of said field thereon.

9. A system for training beginning and intermediate players in soccer basics comprises the following elements:

a game board means having a simulated, realistically colored soccer field illustrated thereon;

a multiplicity of miniature magnetic figurines;

a multiplicity of magnetic name holders;

a multiplicity of flash cards; and an answer key including a plurality of images of a soccer field; the method steps of said system comprising each player:

identifying the parts of said soccer field on the game board means;

placing said miniature magnetic figurines in the correct position on the game board means;

placing said magnetic name holders having name cards of said players inserted therein in correct position on the game board means; and further comprising each coach:

displaying said flash cards having questions in the form of concise terms thereon;

soliciting a response to said questions from each player; and reading said answer key to determine correctness of the response from each player.

10. The system of claim 9 wherein the game board means further includes a magnetic-reactive, write-on surface, for teaching parts of a soccer field, positions of players and diagramming strategies.

11. The system of claim 9 wherein said miniature magnetic figurines include sufficient representations of each player type.

12. The system of claim 9 wherein said multiplicity of magnetic name holders further comprises player name cards for insertion into the slots therein.

13. The system of claim 9 wherein said questions on said multiplicity of flash cards are expressed as concise terms thereon grouped into categories to teach children basic soccer concepts.

14. The system of claim 9 wherein said answer key includes a plurality of images of soccer fields and the definitions of those terms posed on the flash cards.

15. The system of claim 14 wherein said plurality of images of a soccer field comprises a first image including numbers only for player positions thereon.

16. The system of claim 14 wherein said plurality of images of a soccer field comprises a second image having written descriptions of the parts of said field thereon.

17. A method of playing a tabletop baseball board game for a plurality of game players each of said game players competing against each other to collect the most baseball trading cards the parts of said game comprising:

a multiplicity of flash cards, each of which represents one aspect of baseball expressed in a concise term thereon;

a substantially planar game board means having indications thereon describing a baseball diamond having a home plate, a first base, a second base, a third base, an at bat portion listing the names of each player in the order of play, and a scoreboard for listing the number of trading cards won by each of said game players;

a multiplicity of name holders for holding the individual names of each game player; and an answer key; the method steps comprising each game player:

throwing dice to determine a coach for a session;

defining a concise term by one of said game players on a first of said flash cards displayed by the coach;

failing to properly define said term resulting in said flash card being displayed to a second game player;

properly defining said term resulting in retention of said flash card by said second game player;

continuing to display cards by the coach to additional players in this manner until all said flash cards of a session have been retained by said game players; and replacing said flash cards with baseball trading cards in numbers equivalent thereto to each player possessing any of said flash cards.

* * * * *